United States Patent [19]

Gerber

[11] 3,940,605

[45] Feb. 24, 1976

[54] CHEMILUMINESCENT MARKER APPARATUS

[75] Inventor: Robert L. Gerber, Ridgecrest, Calif.

[73] Assignee: The United States of America as represented by the Secretary of the Navy, Washington, D.C.

[22] Filed: Dec. 18, 1974

[21] Appl. No.: 533,905

[52] U.S. Cl. ..... 240/2.25; 102/37.8

[51] Int. Cl.[2] ..... F21V 9/16

[58] Field of Search ..... 240/2.25, 1 R; 222/94; 102/35.6, 37.6, 37.8

[56] References Cited

UNITED STATES PATENTS

| | | | |
|---|---|---|---|
| 3,463,915 | 8/1969 | Day | 240/2.25 |
| 3,500,033 | 3/1970 | Cole et al. | 240/2.25 |
| 3,578,962 | 5/1971 | Gerber | 240/2.25 |
| 3,612,857 | 10/1971 | Beatty | 240/2.25 |
| 3,633,507 | 1/1972 | Morley et al. | 240/2.25 X |
| 3,736,874 | 6/1973 | Gerber | 240/2.25 X |
| 3,745,324 | 7/1973 | Shefler et al. | 240/2.25 |
| 3,829,678 | 8/1974 | Holcombe | 240/2.25 X |

*Primary Examiner*—R. L. Moses

*Attorney, Agent, or Firm*—R. S. Sciascia; Roy Miller; Robert F. Beers

[57] ABSTRACT

A chemiluminescent lighting apparatus for generating an illuminated marker material for delivery to a desired area. Two fluids to be mixed are contained in separate chambers and are separated from a mixing chamber by means of frangible disc-shaped members. A hollow gas generator expells gas when a squib fractures one of its walls. The force of the escaping gas exerts pressure on the two fluids sufficient to fracture the frangible disc members allowing mixing action in the mixing chamber. The mixed fluid chemically reacts to produce light and flows from the mixing chamber to a light transmittable material where it is stored to provide an illuminated area.

6 Claims, 2 Drawing Figures

CHEMILUMINESCENT MARKER APPARATUS

BACKGROUND OF THE INVENTION

The present invention relates to a chemiluminescent lighting apparatus that can be used as a marker head of a missile carried by an aircraft or as an emergency illuminating source.

Numerous devices are presently in use by aircraft to mark desired areas on land or at sea locations so that the area can be easily identified and located again. This procedure is followed on search and rescue missions or to mark targets to be destroyed during military operations. Frequently it is required that the marker be visible at night from high altitudes for substantial periods of time. This is especially true when high performance aircraft are used for ordnance delivery against enemy positions or where it is necessary to establish a reference point for other military operations at night.

One of the major drawbacks of aircraft attacking ground or sea targets with bombs or missiles is the accuracy necessary to hit the chosen target area during reduced visibility conditions or during nighttime operations. Conventional weapons for air to surface attack are usually gravity type bombs and missiles. Because of high speeds of the fighter aircraft and the brief time available over the target the launch constraints required for a visual attack with conventional weapons are severe. In many cases to attain accurate delivery of such weapons at night requires the attacking aircraft to sight the target area from five to seven miles from the target area. Since the attacking aircraft may be flying at altitudes and ranges that make it extremely vulnerable to surface air weapons it is desirable that the aircraft be capable of stand-off ordnance delivery.

Considerable effort has been expended by both the Government and private industry in attempting to construct chemiluminescent lighting devices for either night marking or emergency applications. One of these devices releases a chemiluminescent cloud by means of an aerosol spray.

Another such device used to mark a surface area is a canister filled with chemiluminescent material. This canister when launched from an aircraft or a surface craft bursts on contact with the ground and drives a piston by means of generated gas to eject the chemiluminescent material 20 to 40 feet in the air. As it settles to the ground a large area is covered by the dispersed particles.

Still another type of location marker that is launched from an aircraft are strips of cloth material that first have been saturated with chemiluminsecent material. A container filled with an activator material is ruptured to allow a liquid activator to saturate the cloth material. A predetermined time later the cloth or cloths are ejected from the container and fall to the ground to provide a visible marked area.

SUMMARY OF THE INVENTION

The present invention relates to a chemiluminescent marker apparatus that may be used to mark areas by being carried by a projectile like device or to create a source of light to be used under emergency conditions. A gas generator situated in a closed container pressurizes an oxalate fluid which in turn places pressure on a separate container of hydrogen peroxide fluid. As the pressure reaches a predetermined level the fluids are permitted to flow through their respective orifices to a mixing tube where they are mixed under turbulent flow conditions. The mixed fluid which chemically reacts to produce light is placed either on a substrate material where it is absorbed and later dispersed or, transmitted through flexible tubing to an area to be illuminated.

BRIEF DESCRIPTION OF THE DRAWINGS

For a complete understanding of the nature and features of the invention, reference should be made to the following detailed descriptions taken in connection with the accompanying drawings wherein.

DESCRIPTION OF THE PREFERRED EMBODIMENT

Figure 1:
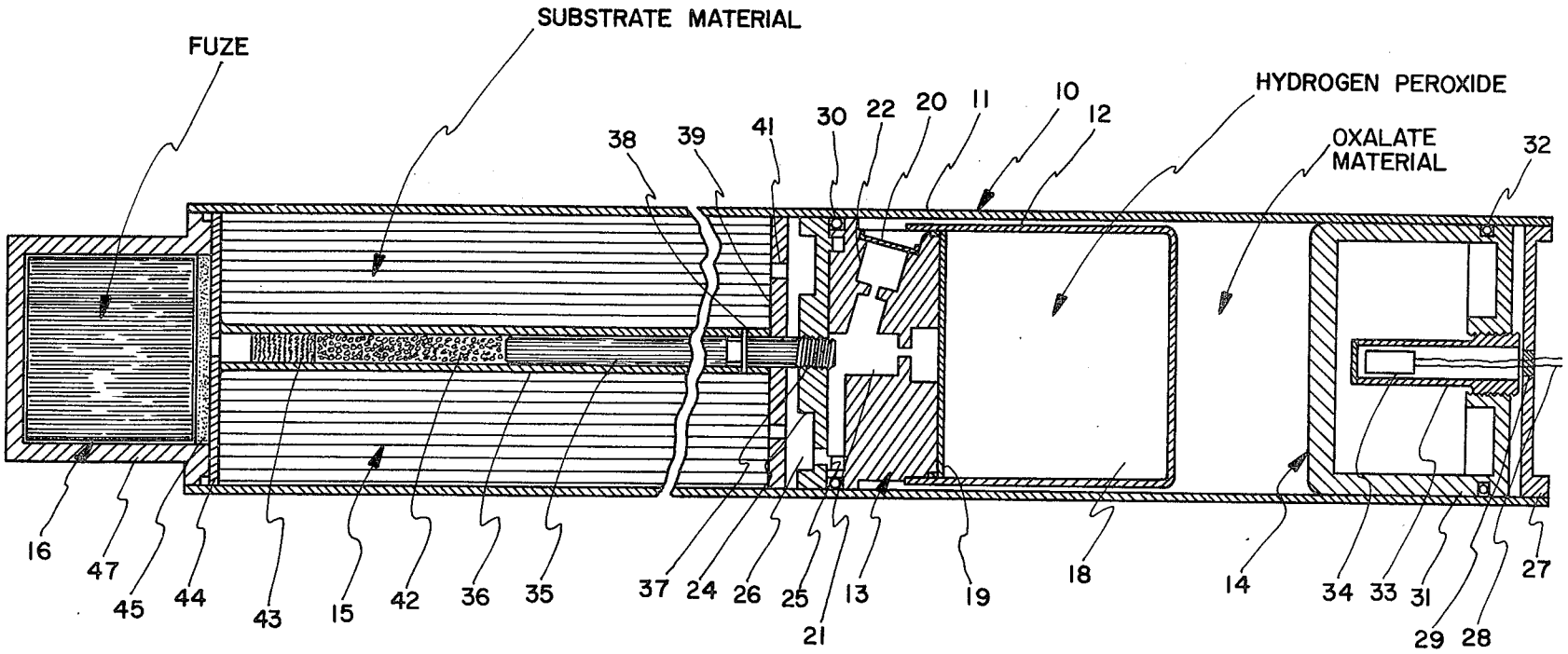
FIG. 1 is a longitudinal view partly in cross section of the chemiluminescent lighting apparatus arrangement for use with an aircraft missile for marking an area on water or land.

Referring now to the drawings, more particularly to FIG. 1, the location marker head apparatus for a missile or the like is generally indicated by numeral 10. A cylindrical aluminum container having wall 11 closed by end cap portions 27 and 47 enclose the entire apparatus to form a unitary container. End cap 27 is provided with plug element 29 for permitting electrical leads 28 to pass into the interior of the container to an explosive actuator such as squib 34. Gas generator 14 has wall 31 in slidable engagement with the interior of wall 11 so as to form a movable piston-like element. Gas and fluid sealing means such as O-ring 32 provides a seal to prevent the escape of gas or fluid between piston wall 31 and wall 11. A hollow chamber formed by the walls of piston element 14 is filled with a gas such as carbon dioxide under high pressure. An annular squib housing 33 is threadably engaged with the end portion of piston 14 to form a passageway for the escape of the gas whenever housing 33 is ruptured to drive piston 14 away from end cap 27.

Mixing assembly 13 is formed as a disc-like member rigidly held in place against wall 11 by means of locking rings or the like. A liquid seal such as O-ring 30 may also be provided to prevent the escape of liquid between the outer circumference of the disc-like member and wall 11. An orifice 21 having its axis located concentric with container 11 extends through disc-like member 13. Another orifice 22 is fabricated in assembly 13 to extend from the outer circumferential surface to meet the axis of orifice 21 at an acute angle. Each orifice communicates with a turbulent mixing chamber 25 that is normal to the centerline of the disc-like member 13. An aperture opposite the orifice end of mixing chamber 25 extends through closure member 24. A centrally located flange which is threaded to one end of the ejector rod 35 is held in position at its circumferential surface by being fastened to the interior of wall 11 by means of locking rings or the like to sustain mixing assembly 13 in position. Attached to a necked down portion of the circumferential surface of assembly 13 is a closed chamber 18. Chamber 18 is formed with thin walls 12 fabricated from a flexible material such as a soft high purity aluminum which is compatible with the stored hydrogen peroxide. Orifice 21 is blocked by means of rupture disc 19 placed between it and one end of chamber 12. Angular orifice 22 is also closed by a disc 20 to prevent the flow of oxalate fluid material from its storage area between the head of piston 14 and container 18. Rupturable disc members 19 and 20 are fabricated from soft aluminum sheet which is scored such that when rupture occurs all fragments are retained in order to prevent blockage of the orifices. Diffusion plate 39 separates substrate material 15 and its ejector mechanism from mixer assembly 13. Stored substrate material 15 consists of long cellulose acetate rods which absorb the mixed chemiluminescent fluids and provide a rigid carrier. Fluid from mixing chamber 13 flows through apertures 41 radially positioned about the center of diffusion plate 39 to saturate material 15.

Centrally located housing tube 36 attached between diffusion plate 39 and front end plate 44 form a housing for the ejector mechanism. Piston rod 35 is slidably fitted within housing tube 36 and is threadably attached to closure plate 24 by means of threaded portion 37. A pin 38 restricts the piston from movement within housing 36. At the other end of ejector rod 35 an explosion charge of powder 42 is held in place by pyrotechnic delay charge 43.

Fuze 16 is housed in end closure portion 47 and may be any fuze mechanism that arms itself when subjected to sustained acceleration forces and fires when a predetermined deceleration force is reached. Fuze 16 contains a powder charge 45 at one end which pressurizes the fuze housing 47 to blow the head of the missile, not shown, free from container 10. An aperture in element 44 allows hot gases from the burning powder charge 45 to ignite pyrotechnic delay charge 43.

The marker apparatus of FIG. 1 is secured to a missile body that is intended for launch by means of a rocket launcher. At time of launch the marker apparatus is initiated by a voltage applied via electrical lead 28 at the same instant as the firing of the missile rocket motor. An explosive actuator or squib 34 ruptures annular housing 33 allowing the high pressure gas within piston-like element 14 to fill the void between end cap 27 and gas generator assembly 14 causing movement away from end cap 27. As gas generator 14 slides along container 10, pressure builds up against the fluid oxalate material which also pressurizes the hydrogen peroxide fluid within container 18 by transmission of the pressure through the flexible walls. Each liquid loads its respective rupture disc until it fails allowing flow to commence. Orifice 22 and orifice 21 meter each fluid in the ratio of three parts oxalate to one part peroxide. The metered liquids flow under pressure through mixing chamber 26 under turbulent flow conditions. This causes the liquids to be mixed in a short distance. The mixed liquid is expelled through apertures 41 in diffusion plate 39. Substrate material 15 forming a rigid carrier for the fluids soaks up the mixed fluids that are chemically reacting to produce light.

At rocket motor burn-out the missile decelerates causing fuze 16 to ignite powder 45 separating the marker head from the rocket motor. Hot gases from burning powder 45 initiate a predetermined pyrotechnic time delay 43 which allows the marker to coast through the air to allow continued mixing after separation. After the lapse of the time delay, powder 42 is ignited forcing ejector piston 35 to shear pin 38 forcing the tubular housing 36 and substrate material 15 out of container 10 causing them to spread over a wide area. This creates a lighted area over barren ground, water and dense foliage that is clearly visible from a long distance.

Figure 2:
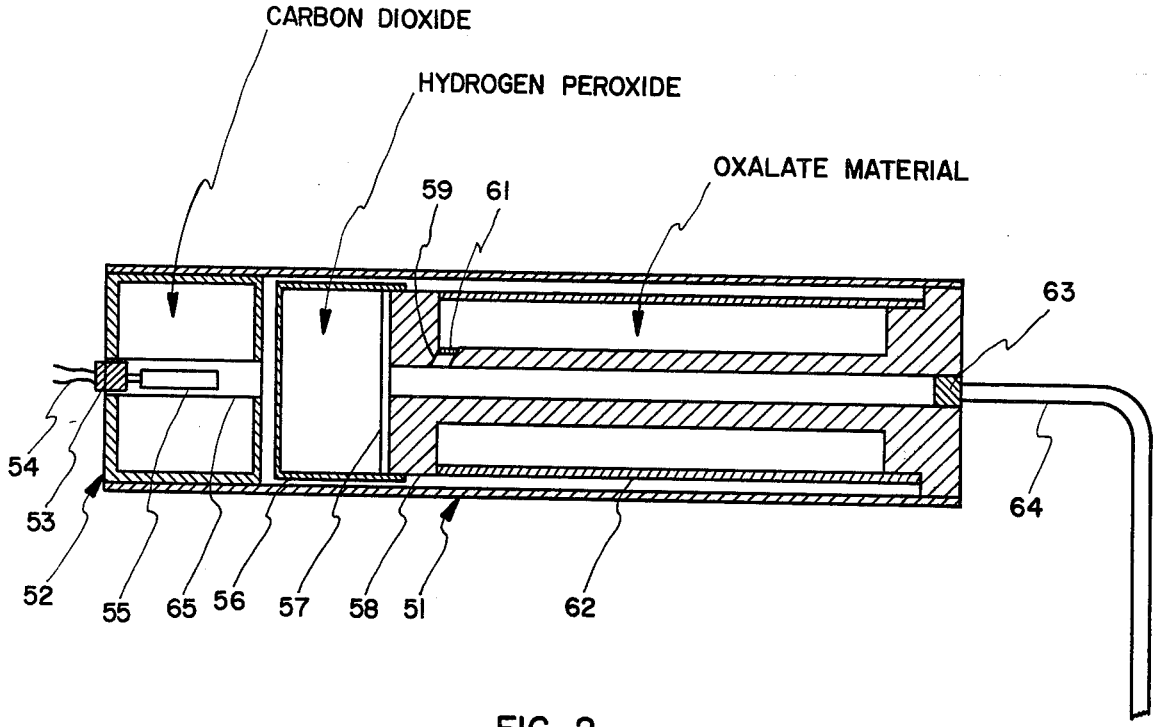
FIG. 2 is a longitudinal cross sectional view of the chemiluminescent lighting apparatus for use as an emergency source of light.

Referring now to FIG. 2, which shows container assembly 51 that is used to provide an emergency chemiluminescent lighting system. Gas generator 52 is positioned to close one end of container assembly 51. A centrally located rupturable housing 65 extends through gas generator 52 and contains an electrically actuated explosive actuator such as squib 55. Electric leads 54 extend from squib 55 through sealing plug 53 to the exterior of container assembly 51. An electrical power source, not shown, attached to leads 54 is used to detonate squib 55 at a predetermined time.

A mixing tube 58 fabricated in the form of an elongated spoollike member closes the other end of container 51. A necked down portion at one end of mixing tube 58 permits closure of its shank portion by thin wall 62 to form a closed container to hold fluid oxalate material. Fluid within this chamber is closed off by means of rupture disc 61 closing orifice 59. Mixing tube 58 has a centrally located hole extending along its longitudinal axis. A closed thin walled container formed by a wall 56 of a flexible material forms a container for hydrogen peroxide fluids. The hydrogen peroxide is prevented from entering the mixing tube by rupturable disc 57. Flexible light transmitting tube 64 is attached by means of sealing plug 63 to receive the mixed fluids and store the glowing fluids in tube 64 to serve as an emergency light source.

When emergency light is needed, a source of voltage, not shown, is applied via electrical leads 54 to detonate the explosive actuator or squib 55. Wall 65 ruptures allowing escape of high pressure carbon dioxide gas against flexible walls 56 and 62. As pressure builds up, discs 57 and 61 rupture allowing the fluids to be intermixed under turbulent conditions as they travel through mixing tube 58. The two fluids chemically react to produce light and are conducted and stored by means of flexible light transmitting tube 64.

The above apparatus allows the use of a two fluid component chemiluminescent system that keeps the fluids in separate storage tanks until mixed. This permits the use of a low viscosity system that permits storage of the mixed liquids on an absorbing substrate carrier thus eliminating the need for a fluid viscosity that does not have the disadvantage of being applied directly to the object to be marked where it may run off or soak into the object.

What is claimed is:

1. A chemiluminescent light apparatus for generating an illuminated marker comprising:

a tubular housing;

mixing means rigidly mounted within said tubular housing;

first and second fluid compartments within said tubular housing having frangible means separating said fluid compartments from said mixing means and adapted to deliver fluid to said mixing means upon rupture of said frangible means;

gas generator means having an explosive actuator for releasing a predetermined quantity of gas to cause a force to be exerted on said first and said second fluid compartments for rupturing said frangible means; and light transmittable means attached to said mixing means for receiving and storing the mixed fluids;

whereby the light given off from the chemical action of the mixed fluid forms a means of illumination of a given area.

2. The apparatus of claim 1 wherein said mixing means comprises:

an elongated disc-like member having a centrally disposed aperture and an angularly disposed aperture each of said apertures being closed at one end by said frangible means.

3. The apparatus of claim 1 wherein said gas generator means comprises:

a hollow cylindrical housing forming a piston member closing one end of said tubular housing;

an annular squib housing member extending into said cylindrical housing; and a squib positioned within said annular housing;

wherein actuation of the squib fractures the annular housing and allows escape gas within the piston member.

4. The apparatus of claim 1 wherein said light transmittable means is a length of flexible tubing.

5. The apparatus of claim 1 wherein said light transmittable means is a plurality of elongated cylindrical rods.

6. The apparatus of claim 5 wherein said cylindrical rods are formed of cellulose acetate.

* * * * *